United States Patent [19]

Dumschat

[11] Patent Number: 4,635,463

[45] Date of Patent: Jan. 13, 1987

[54] ARRANGEMENT FOR THE EJECTION OF THE SHAPED PARTS OUT OF THE MATRIX OF A DEFORMATION PRESS

[75] Inventor: Helmut Dumschat, Donzdorf, Fed. Rep. of Germany

[73] Assignee: L. Schuler GmbH, Goeppingen, Fed. Rep. of Germany

[21] Appl. No.: 733,773

[22] Filed: May 14, 1985

[30] Foreign Application Priority Data

May 18, 1984 [DE] Fed. Rep. of Germany ..... 3418508

[51] Int. Cl.[4] ..... B21D 45/02; B21D 45/04

[52] U.S. Cl. ..... 72/427; 72/344; 403/15; 411/401; 425/422; 10/11 E

[58] Field of Search ..... 10/11 E; 72/344, 345, 72/427; 425/422, 554, 556; 411/378, 383, 401; 403/15; 269/93, 99, 100; 74/829, 833, 834

[56] References Cited

U.S. PATENT DOCUMENTS

| | | | |
|---|---|---|---|
| 2,752,801 | 7/1956 | Olson | 269/93 |
| 3,238,761 | 3/1966 | Hoyt | 72/345 |
| 3,688,322 | 9/1972 | Van De Meerendonk | 72/427 |
| 4,075,923 | 2/1978 | Latham | 411/378 |
| 4,468,019 | 8/1984 | Staudenmaier | 269/99 |

FOREIGN PATENT DOCUMENTS

| | | | |
|---|---|---|---|
| 41633 | 12/1981 | European Pat. Off. | 72/427 |
| 2526730 | 11/1976 | Fed. Rep. of Germany | 72/467 |
| 640809 | 1/1979 | Japan | 72/427 |

*Primary Examiner*—Lowell A. Larson
*Attorney, Agent, or Firm*—Barnes & Thornburg

[57] ABSTRACT

An arrangement for ejecting formed parts out of the matrix of a deformation press, in which for avoiding jamming of the segment of an ejection arrangement, which is displaceably and fixedly supported at the guidance in the shape of a circular arc of the driving lever, the mutually contacting surfaces are made according to different radial dimensions whereby the radial dimension of the counterabutment surface of the segment is slightly smaller than the radial dimension of the abutment surface of the driving lever. Clamping elements constructed as pressure cylinders serve for fixing the segment at the driving lever in a position adjustable by an adjusting mechanism; the clamping elements are installed in the segment spaced from one another in the direction of the longitudinal dimension of the circular arcuate guidance.

6 Claims, 3 Drawing Figures

ARRANGEMENT FOR THE EJECTION OF THE SHAPED PARTS OUT OF THE MATRIX OF A DEFORMATION PRESS

The present invention relates to an arrangement for ejecting the shaped parts out of the matrix of a deformation press, including an ejector movable in the matrix and a drive lever operatively connected with the drive of the deformation press and with the ejector by way of a pivotal connection, whereby the pivotal connection consists of a segment which is adjustable on a circular arcuately shaped guidance at the driving lever by way of an adjusting mechanism and is adapted to be fixed and loosened in a clamping location by way of a clamping element, and of at least one coupling member between the segment and the ejector.

Deformation presses, especially those for the massive deformation of unworked parts or blanks into shaped parts include ejectors on the matrix side in a number corresponding to the operating steps to be carried out. In addition to the ejection function after the deforming operation the ejectors serve in at least some working stages for the determination of the penetration depth of the blank into the matrix during the deformation operation. The ejectors are individually adjustable during standstill of the press for each working stage. Both the stroke length as also the ejection instant can be adjusted steplessly. The ejection operation requires large force transmissions. A change—reduction—of the ejection path during the operation leads necessarily to the collision between the deformed shaped part remaining in the matrix and the newly supplied blank.

A multistage press for the non-cutting manufacture of shaped parts such as threaded bolts, nuts and the like is described in the DE-PS No. 20 28 963 with a crankshaft driven at the same rate as the ram. The deflection movement thereof is transmitted onto a two-armed drive lever which is operatively connected with the ejector by way of a pivotal connection. The pivotal connection essentially consists of a coupling member pivotally connected at the ejector. The coupling member is pivotally secured with its opposite end at a segment which is adapted to be adjusted and fixed in an end position of the ejector at the drive lever in a guidance of a circular arc about the point of pivotal connection of the coupling member at the ejector. A threaded bolt securely connected with the segment and having a nut mounted thereon serves for that purpose. By loosening the nut, adjustment of the segment along the guidance of circular arcuate shape and by tightening the nut, different lever ratios and thus ejection movements of different lengths on the part of the ejector are possible, and more particularly without an adjustment of the starting position of the ejector. The manner of the fastening of the segment opens up the danger of an adjustment of the segment along the circular arcuate guidance during the operation and the jamming or wedging of the segment on respectively in the abutment surface of the circular arcuate guidance. The adjustment of another ejection path with new installations of the deformation press, for example, with a work-tool change, cannot be automated. The course of movement of the ejector is determined by the manner of the crankshaft drive of the drive lever and therefore cannot be matched to conditions based on different work tools and workpieces.

A deformation press with an ejector drive is also described in the DE OS No. 30 21 790. A drive lever pivotal about a point of rotation by a cam drive in the rhythm of the deformation movement of the press includes in a lever arm a circular arcuate guidance, on which a segment is adjustable by way of a pressure cylinder for changing the lever ratio and is adapted to be fixed and released by way of a splined or keyed connection acted upon by the pressure cylinder. The segment is pivotally connected by way of a coupling member at a two-armed ejection lever which is operatively connected with the ejector. The circular arcuate guidance and the segment are arrested in the radii of curvature of their contact surfaces on a common center point of a circular arc. The center point lies in the point of pivotal connection of the coupling member at the ejector level with maximum ejection position. The keyed connection acts tangentially on the outer circumference of the circular arcuate guidance in response to tightening of the segment against the inner circumference. Also in this arrangement the possibility of the jamming or wedging of the segment at the abutment surface of the drive lever exists without a loosening movement in the sense of a lifting movement of the segment from the drive lever being effected by the keyed connection so that an automatic adjustment of the segment at the circular arcuate guidance is not assured. The coupling member operates during the transmission of the ejector movement in tension, and thus clamping elements have to be guided about the drive lever on both sides. The advantage of this ejection arrangement of the smaller force application during fixing of the segment by way of the keyed or spline action is considerably reduced by the required fitting operations such as touching up and scraping operations.

It is the object of the present invention to prevent the jamming behavior of such slide guidances during the disengagement of the mutually clamped together transmission members in arrangements of the aforementioned type and to automate the adjustment of the transmission ratio with work tool-workpiece changes.

The underlying problems are solved according to the present invention in that the abutment surface at the guidance in the form of a circular arc for the abutment of the segment and the counter-abutment surface at the segment have differently large radii of curvature, whereby the counter-abutment surface is made according to a slightly smaller radial dimension than the abutment surface, and in that at least one clamping element is mounted at the segment and movable therewith, with clamping elements arranged at a distance from one another and adapted to be fixed at the circular arcuate guidance to fix the segment at this guidance.

By the use of two pressure cylinders as controllable clamping elements, each individual clamping place can be selectively tightened and released.

According to a still further feature of the present invention the structural dimensions within the area of the suspension of the coupling member can be reduced if one pressure cylinder each is worked into the segment at each clamping place which includes a hollow cylinder space formed by the segment, a closure plate closing off the hollow space and adapted to be removed, a pressure actuated piston adapted to move in the hollow cylinder space and an anchor bolt inserted into the piston and adapted to be tightened in the piston which has an anchor-shaped end portion adapted to be clamped fast at the drive lever in the clamping groove of the arcuate guidance.

According to still a further feature of the present invention, an adjustment between a maximum ejection stroke and an ejection stroke at least near zero is possible by the structural arrangement of the present invention.

According to still another feature of the present invention, it is possible to fix the clamping element at the segment in a preferred arrangement.

Some of the advantages obtainable with the present invention consist of the operating reliability of the arrangement, the fully automated adjusting operation and the slight surface pressure between the contact surfaces of the circular arcuate guidance and the segment. It is essential thereby that the manufacture of the contact surfaces can take place within the tolerances predetermined for these structural sizes and that this will lead to an areal contact without necessary fitting and finishing operations.

These and other objects, features and advantages of the present invention will become more apparent from the following description when taken in connection with the accompanying drawing which shows, for purposes of illustration only, one embodiment in accordance with the present invention, and wherein.

Figure 1:
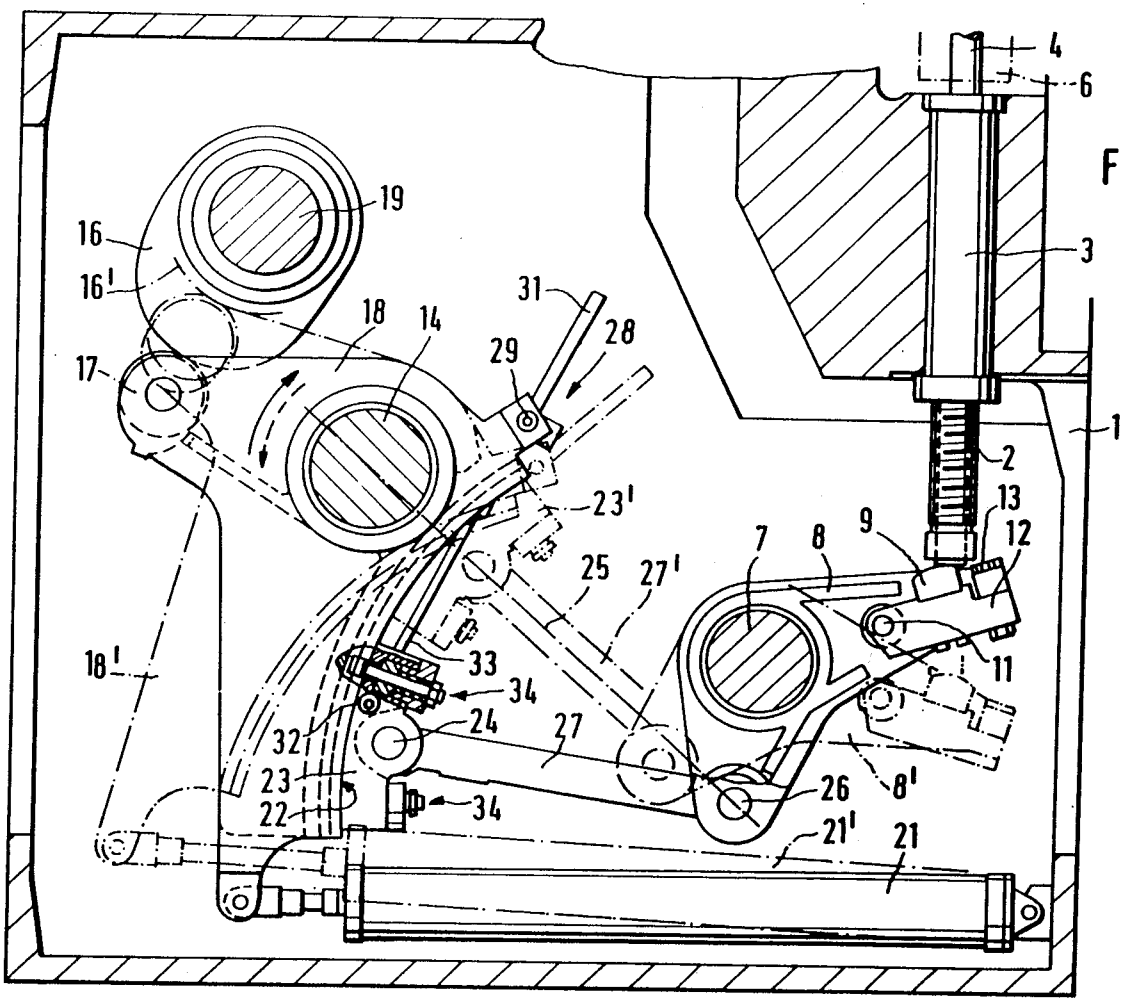
FIG. 1 is a cross-sectional view through a deformation press within the area of the ejection mechanism in accordance with the present invention and on a strongly reduced scale.

Referring now to the drawing wherein like reference numerals are used to designate like parts, and more particularly to FIG. 1, an ejector 2 is supported in a bearing bushing 3 within a partial area of a deformation press, press frame 1, and is displaceably supported in the bearing bushing 3. The bearing bushing includes at least one return spring (not shown) for the ejector 2. The projecting end portion 4 of the ejector 2 extends into a matrix 6 indicated in FIG. 1 in dash and dotted lines. Furthermore, an ejector level 8 is pivotally supported in the press frame 1 by way of a shaft 7; the ejector lever 8 is placed against the ejector 2 by way of a pressure member 9. The pressure member 9 is located at a shifting lever 12 pivotally supported at the ejector lever 8 at 11. The shifting lever 12 is held in a position guided against the ejector 2 by means of a tearing pin 13 that serves the safety of the ejector mechanism in case of an ejector 2 blocked by the shaped part. A drive lever 18 which is actuated by a cam disc 16 by way of a roller 17 is pivotally connected on a further shaft 14. The cam disc 16 is rigidly secured, possibly interchangeably secured on a shaft 19 driven by the press drive. The drive lever 18 is acted upon by a pressure cylinder 21 for the abutment of the roller 17 at the cam disc 16. The lines 18' and 21' in dash and dotted lines show these parts in the position of the abutment of the roller 17 at the base circle 16' of the cam disc 16. A guidance in the shape of a circular arc which is generally designated by reference numeral 22 is provided at the drive lever 18, which is illustrated in detail in FIGS. 2 and 3 and will be described more fully hereinafter. A segment 23 is slidingly displaceably supported at the circular arcuate guidance 23 in the longitudinal direction of the arcuate guidance 22. The arcuate guidance 22 extends up to beyond the area of the point of rotation at the drive lever 18. A coupling member 27 is pivotally supported in a point of pivotal connection 24 at the segment 23 and in a point of pivotal connection 26 at the ejector lever 8 for the transmission of the pivot movement of the drive lever 18 onto the ejection lever 8. The segment 23 is adapted to be adjusted in the circular arcuate guidance 22 into the position 23' of the segment 23 indicated in dash and dotted lines and into the position 27' of the coupling member 27 by means of an adjusting mechanism generally designated by reference numeral 28; the segment 23 is also adjustable into any intermediate position between the positions shown in full and dash and dotted lines. The adjustment takes place with an ejector lever position that corresponds to the maximum ejection stroke, whereby the guidance radii of the circular arcuate guidance 22 have their center point in the point of pivotal connection respectively point of rotation 26 of the coupling member 27 at the ejector lever 8. The position 8' illustrated in dash and dotted lines indicates the fully retracted ejector lever 8. The adjusting mechanism 28 essentially consists, for example, of a pressure cylinder with a cylinder housing 31 pivotally supported at the drive lever 18 in a point of rotation 29 and of a piston rod 33 pivotally connected at the segment 23 at 32. The fixing of the segment in the position adjusted by way of the adjusting mechanism 28 takes place thereby by way of two clamping elements generally designated by reference numeral 34.

Figure 2:
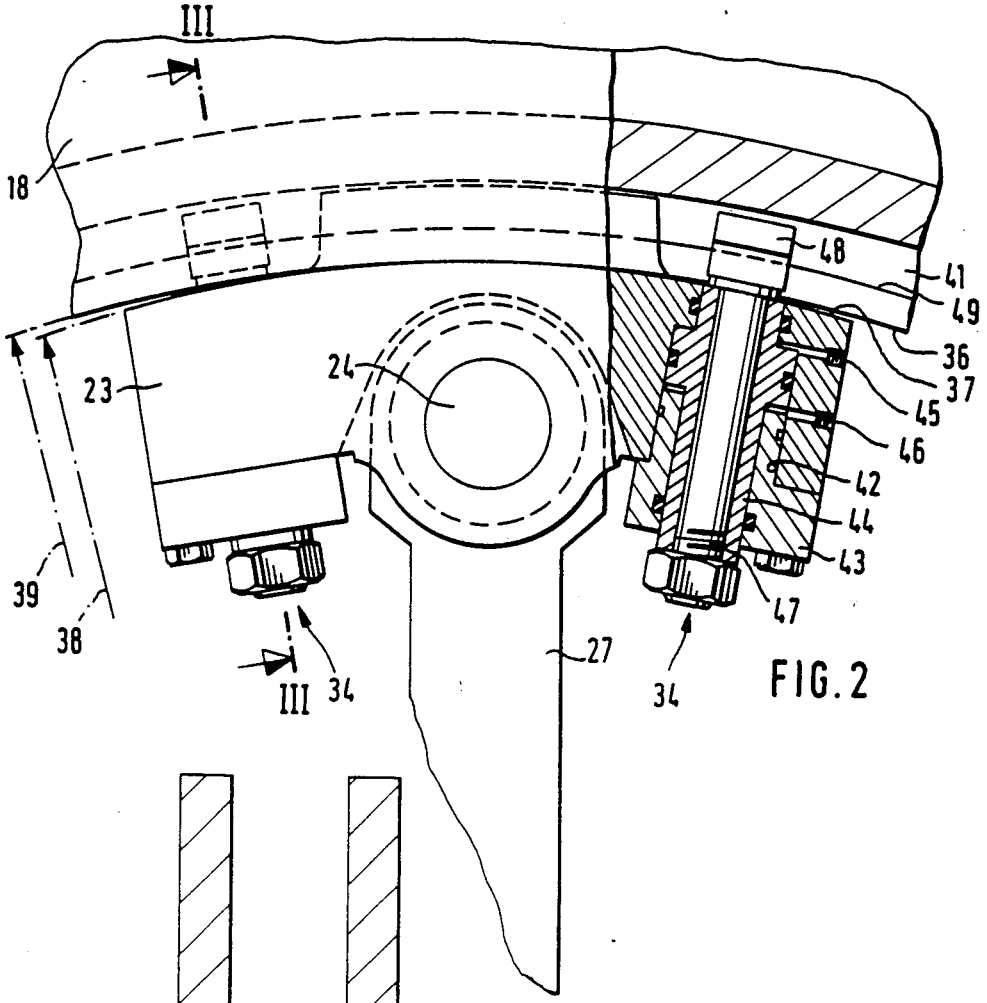
FIG. 2 is a partial view, on an enlarged scale, of a portion of FIG. 1 within the area of the segment.

As illustrated in detail in FIG. 2, the guidance 22 in the shape of a circular arc includes an abutment surface 36, against which the segment 23 is placed with a counterabutment surface 37. The abutment 36 and counterabutment surface 37 are manufactured according to different radial dimensions, as can be seen in the drawing where it is shown strongly exaggerated for ease of understanding, whereby the radial dimension 38 according to which the counterabutment surface 37 is made, is slightly smaller than the radial dimension 39 of the abutment surface 36. The circular arcuate guidance 22 further includes a T-shaped groove 41 into which is inserted one T-groove bolt 47 per clamping place or possibly the T-shaped end portion 48 of a piston.

Figure 3:
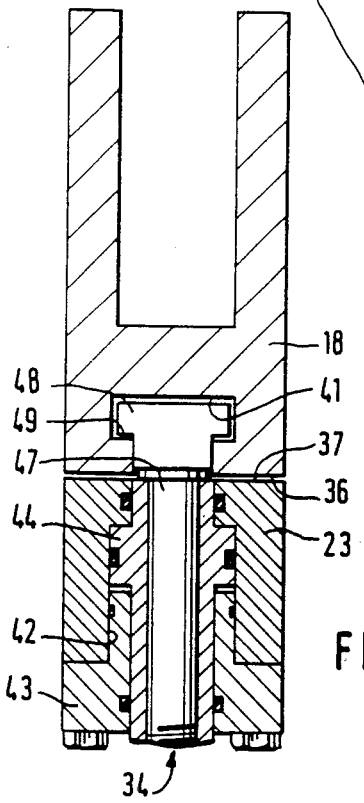
FIG. 3 is a cross-sectional view taken along line III—III of FIG. 2.

The fixing of the segment 23 at the circular arcuate guidance 22 is formed at each clamping place by one separate pressure cylinder each or, as shown in the embodiment according to FIGS. 1 to 3, in that hollow spaces 42 are machined into areas of the segment 23 which are spaced from one another and are disposed in the longitudinal direction of the circular arcuate guidance 22; the hollow spaces 42 are closed off by a closure plate 43. One piston 44 is inserted into each hollow space 42 of the thus formed clamping element generally designated by reference numeral 34, which is adapted to be displaced in the hollow space 42, acted upon by way of pressure lines 45, 46. A T-groove bolt 47 is movable in unison with the piston 44, which is adapted to be placed with the T-shaped end portion 48 to the rear of the abutment surface 49 and which is adapted to be clamped thereagainst. The clamping takes place by deforming drive lever 18 and segment 23 through a pressure application by way of the T-shaped end portion 48 of the piston 44 actuated by the pressure in line 45. The clamping of the drive lever 18 and of the segment 23 causes both the lever 18 and segment 23 to deform, with the radius 39 of lever 18 being shortened and the radius 38 of the segment 23 being lengthened, to provide a tight fit between segment 23 and lever 18 in the clamped position. Release of the piston allows the lever 18 and segment 23 to be restored to the undeformed position of radii 39 and 38. The deformation of the drive lever 18 (made, for example, of cast steel or spheroidal graphite iron) and of the segment 23 takes place considerably below the elasticity limit thereof. The disengagement of the clamping elements 34 takes place under simultaneous deformation of the drive lever 18 and of the segment 23 back into their original shape by relieving the pressure line 45 and possibly by applying pressure to the pressure line 46.

While I have shown and described only one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of appended claims.

I claim:

1. An arrangement for ejecting shaped parts out of a matrix means in a deformation press, comprising ejector means movable in the matrix means, drive means for the deformation press, a pivotal drive lever means operatively connected with the drive means of the deformation press and with the ejector means by way of pivotal coupling means, said drive lever means including a guide means in the shape of a circular arc, said pivotal coupling means including a segment adjustable at the drive lever along said guide means by way of an adjusting means and operable to be fixed or released by way of clamping means said guide means having an abutment surface for the abutment of the segment and said segment having a counterabutment surface, said abutment surface and counterabutment surface having differing radii of curvature, the counterabutment surface being made according to a slightly smaller radial dimension than the abutment surface, said clamping means being mounted on the segment and being movable in unison therewith, said clamping means including plural clamping members operable to be fixed at the guide means and arranged spaced from one another to fix the segment at the guide means by deforming the guide means and segment at the abutment and counterabutment surfaces.

2. An arrangement according to claim 1, wherein said clamping members are actuated by a pressure cylinder arranged at the segment in each clamping place, the clamping members including a piston which is provided with an anchor-shaped end portion adapted to be clamped fast at the driving lever in a clamping groove of the guide means.

3. An arrangement according to claim 1, wherein the clamping members comprise one pressure cylinder machined into the segment at each clamping member place, each pressure cylinder including a hollow cylinder space formed by the segment, removable closure plate means closing off the hollow cylinder space, a piston operable to be acutated by pressure and movable in the hollow cylinder space, and anchor bolt means inserted into the piston and adapted to be tightened in the piston, said anchor bolt means including an anchor-shaped end portion clampable at the driving lever in a clamping groove of the guide means.

4. An arrangement according to claim 1, in which the guide means for the segment extends in a circular arc whose center point is located in the point of pivotal connection of the coupling means at the ejector means when the ejector means is pivoted into an end ejection stroke position, the guide means being extended beyond the area of the point of pivotal connection of the driving lever, and in that in a given position of the segment a straight line results from the connection of the point of pivotal connection of the coupling means at the ejector means, the point of pivotal connection at the segment and the pivot point of the driving lever.

5. An arrangement according to claim 1, in which the guide means is in the shape of a circular arc, the center point of the arc lying at the point of pivotal connection of the coupling means at the ejector lever when the latter is in its end ejection stroke position, and wherein a given position of the segment a straight line results from the connection of the point of pivotal connection of the coupling means at the ejector lever, the point of pivotal connection at the segment and the pivot point of the driving lever.

6. An arrangement according to claim 1, wherein one clamping means each is arranged on both sides of the point of pivotal connection of the coupling means at the segment which are arranged spaced from one another in the longitudinal direction of the segment.

* * * * *